US007806746B2

(12) United States Patent
Walterscheid

(10) Patent No.: US 7,806,746 B2
(45) Date of Patent: Oct. 5, 2010

(54) NOVELTY DEVICE HAVING BRAIDED SLEEVE BODY AND ITS ASSOCIATED METHOD OF OPERATION

(76) Inventor: Steve Walterscheid, P.O. Box 7409, Bend, OR (US) 97708

( * ) Notice: Subject to any disclaimer, the term of this patent is extended or adjusted under 35 U.S.C. 154(b) by 303 days.

(21) Appl. No.: 11/605,074

(22) Filed: Nov. 28, 2006

(65) Prior Publication Data

US 2008/0125007 A1 May 29, 2008

(51) Int. Cl.
*A63H 13/10* (2006.01)
*A63H 33/00* (2006.01)

(52) U.S. Cl. ..... 446/308; 446/486

(58) Field of Classification Search ..... 446/308, 446/309, 311, 486, 385, 72
See application file for complete search history.

(56) References Cited

U.S. PATENT DOCUMENTS

| | | | | | |
|---|---|---|---|---|---|
| 1,657,936 | A * | 1/1928 | Nebel | 446/177 |
| 2,153,957 | A | 4/1939 | Davis | 46/1 |
| 2,224,456 | A * | 12/1940 | Janas | 446/300 |
| 3,501,861 | A * | 3/1970 | Goldfarb et al. | 446/177 |
| 3,655,193 | A * | 4/1972 | Jones | 473/572 |
| 3,954,266 | A * | 5/1976 | Carrano et al. | 273/348.2 |
| 4,152,863 | A | 5/1979 | Kubiatowicz | 46/1 |
| 4,219,959 | A * | 9/1980 | Fleischer | 446/486 |
| 6,315,687 | B1 * | 11/2001 | Todd et al. | 473/579 |
| 7,001,292 | B1 * | 2/2006 | Rappaport | 473/570 |
| 7,140,945 | B2 * | 11/2006 | Dinhofer | 446/378 |
| 2002/0032087 | A1 * | 3/2002 | Jamison | 473/579 |

* cited by examiner

*Primary Examiner*—Gene Kim
*Assistant Examiner*—Alyssa M Hylinski
(74) *Attorney, Agent, or Firm*—LaMorte & Associates

(57) ABSTRACT

A novelty popper toy and its associated method of operation. The popper toy has a head section that is supported on a braided sleeve body. When the popper toy is compressed, the braided sleeve body elastically deforms from an uncompressed state to a compressed state. While in the compressed state, the braided sleeve body stores energy. If the compression force is suddenly released, the braided sleeve body releases its stored energy and pops back into its uncompressed state. As the braided sleeve body returns to its uncompressed state, it rapidly expands, therein providing enough force to propel the entire popper toy into the air. The popper toy can be delayed in its expansion and/or prevented from flying into the air by the addition of a suction cup to the popper toy.

9 Claims, 7 Drawing Sheets

NOVELTY DEVICE HAVING BRAIDED SLEEVE BODY AND ITS ASSOCIATED METHOD OF OPERATION

BACKGROUND OF THE INVENTION

1. Field of the Invention

In general, the present invention relates to toy and similar novelty devices that have resilient bodies, therein enabling the toy to pop up after having been compressed. More particularly, the present invention relates to toys and novelty devices having components made from braided sleeves.

2. Description of the Prior Art

In the toy industry, "poppers" is the name commonly given to a class of toys that pop up after having been manually depressed. Such toys commonly have coil springs and suction cups. The spring is manually compressed until the suction cup can engage the surface under the toy. The compressed spring acts to free the suction cup. When the suction cup loses suction, the energy stored by the spring is released and the toy jumps or 'pops' up into the air.

In recent years, toy manufacturers have been becoming more concerned with product safety. Traditional 'popper' toys that use compressed springs have certain inherent safety concerns. First, it is difficult to permanently attach a suction cup or a plastic novelty object to a metal spring. If a child pulls upon a traditional popper toy, as often happens, the spring detaches, therein exposing a sharp metal point. Furthermore, exposed metal springs have a tendency to pinch skin when compressed. Exposed metal springs also have a tendency to become entangled in a child's hair.

In the long history of toys, poppers have been made that do not utilize metal springs. Such spring-free poppers are typically made by forming a concave form out of an elastic material. The concave form is manually deformed into a convex structure, therein storing potential energy. At the moment the toy moves from its convex shape to its normal concave shape, energy is released and the toy pops into the air. Such non-spring popper toys are exemplified by U.S. Pat. No. 2,153,967 to Davis, entitled Jumping Toy and U.S. Pat. No. 4,152,863 to Kubiatowicz, entitled Popper Toy.

A problem associated with prior art spring-free popper toys is that it is very difficult to attach secondary objects, such as character heads, to the popper and still have the popper function correctly. A need therefore exists for a new structure for a popper toy that does not use metal springs, yet enables the popper device to be configured into a variety of novelty shapes. This need is met by the present invention as described and claimed below.

SUMMARY OF THE INVENTION

The present invention is a novelty popper toy and its associated method of operation. The popper toy has a head section that is supported on a braided sleeve body. When the popper toy is compressed, the braided sleeve body elastically deforms from an uncompressed state to a compressed state. While in the compressed state, the braided sleeve body stores energy. If the compression force is suddenly released, the braided sleeve body releases its stored energy and pops back into its uncompressed state. As the braided sleeve body returns to its uncompressed state, it rapidly expands, therein providing enough force to propel the entire popper toy into the air.

The popper toy can be delayed in its expansion and/or prevented from flying into the air by the addition of a suction cup to the popper toy.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention popper toy assembly can be configured in many different ways, only a few simple embodiments are shown. The embodiments have been selected for ease of understanding and illustration. It should be understood that the selected embodiments are only exemplary and they should not be considered a limitation on the scope of the present invention as defined by the claims.

Figure 1:
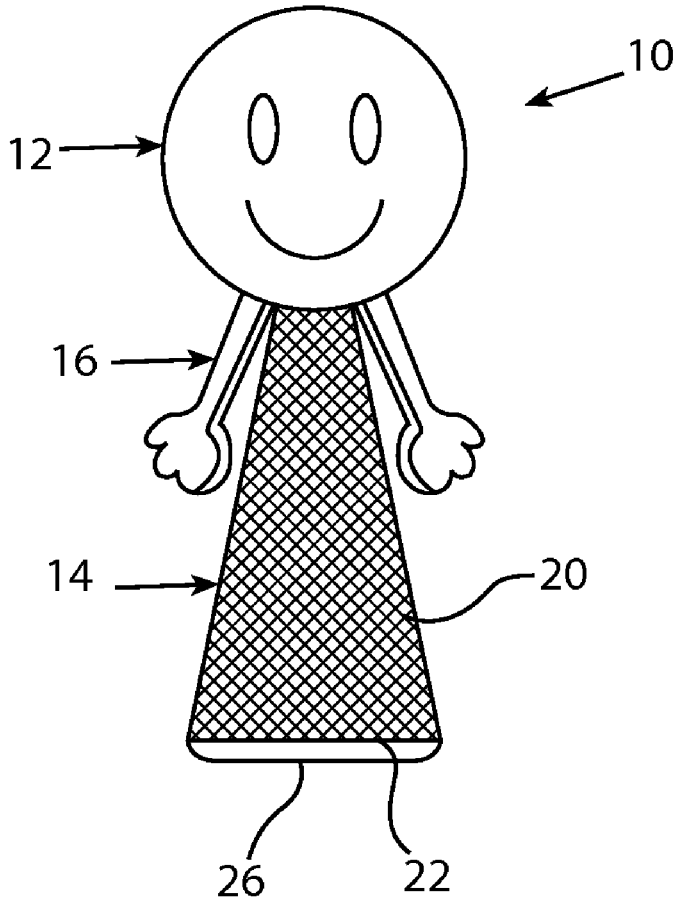
FIG. 1 is a front view of an exemplary embodiment of a popper toy assembly.
Figure 2:
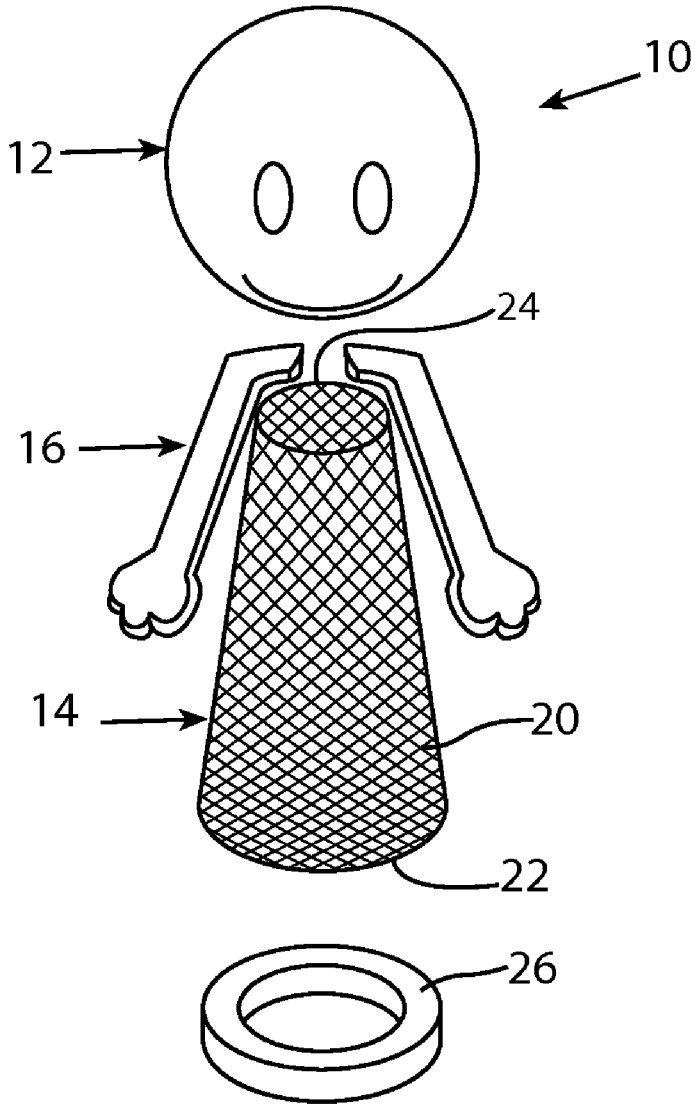
FIG. 2 is an exploded view of the embodiment of FIG. 1.

Referring to both FIG. 1 and FIG. 2, there is shown a popper toy assembly 10. The popper toy assembly 10 has a head section 12, a body section 14 and lateral extensions 16 that extend outwardly between the head section 14 and the body section 14. In the shown embodiment, the popper toy assembly 10 is configured as a novelty character. Accordingly, the head section 12 is shaped as a character head and the lateral extensions 16 are shaped as arms.

The head section 12 of the popper toy assembly 10 is preferably made of foam or another soft, lightweight material. As will be explained, the popper toy assembly 10 pops up into the air. The use of soft, lightweight material for the head section 12 prevents the head section 12 from causing any impact injuries as it flies. Furthermore, the use of soft, lightweight material enables the popper toy assembly 10 to pop up a good distance into the air.

The lateral extensions 16 of the popper toy assembly are also made from soft, lightweight material, such as felt or sheet foam. The lateral extensions 16 serve a purpose in the operation of the popper assembly 10, as will later be described.

The body section 14 of the popper toy assembly 10 is primarily made from a braided sleeve 20. Braided sleeves are traditionally used in industry to protect the exterior of flexible cables. Braided sleeves are essentially tubes of interwoven plastic strands. The strands that interweave in a helical pattern are called cross-over stands. Strands that run straight along the length of a braided sleeve are called warp strands. The cross-over stands and warp stands are interwoven, therein forming the braided sleeve. The resiliency of the braided sleeve 20 is determined by the resiliency and composition of the cross-over stands and warp stands in the weave.

In the present invention popper assembly, the strands of the braided sleeve 20 are plastic. Accordingly, they can be manufactured in any selected color and embody a high degree of flexibility. The braided sleeve 20 is woven into a frustum shape. Accordingly, the braided sleeve 20 has a wide bottom end 22 and a narrow top end 24. The various strands in the braided sleeve 20 may be heat boded together along the wide bottom end 22 and the narrow top end 24 to prevent the stands from fraying.

When the braided sleeve 20 is compressed along its length, the braided sleeve 20 shortens and widens. As a braided sleeve 20 shortens and widens, it stores energy. As soon as the compression force is removed, a braided sleeve 20 will spring back into its uncompressed shape, therein releasing the stored energy.

The body section 14 of the popper toy assembly 10 also includes a ring of foam 26 that is attached to the wide bottom end 22 of the braided sleeve 20. The ring of foam 26 provides friction to the bottom of the popper toy assembly 10 and prevents the braided sleeve 20 from moving while being compressed.

Figure 3:
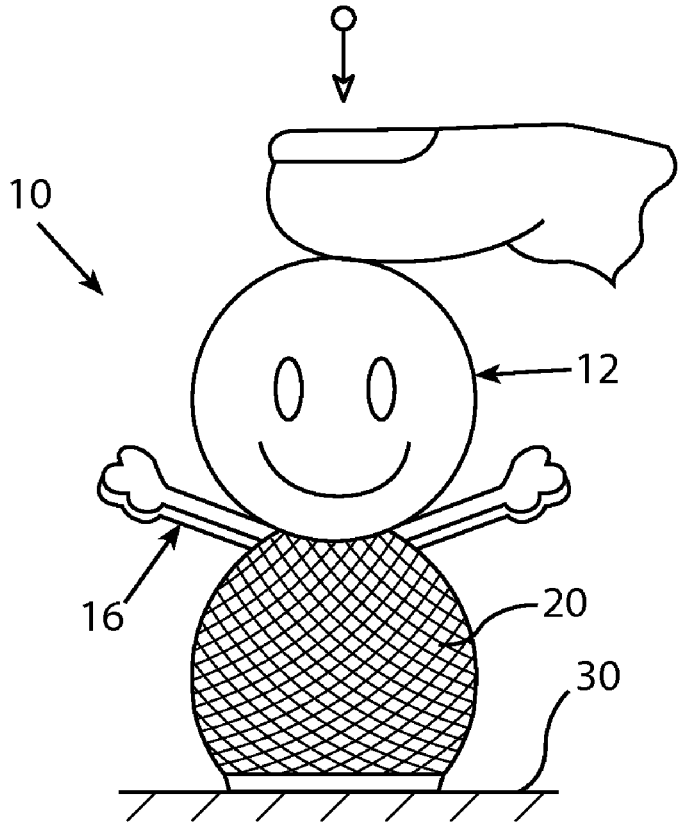
FIG. 3 shows the embodiment of FIG. 1 in a compressed state.

Referring to FIG. 3, it can be seen that in order to operate the popper toy assembly 10, the ring of foam 26 at the wide bottom end 22 of the popper toy assembly 10 is placed on a flat surface 30. A compression force is applied downwardly to the head section 12 of the popper toy assembly 10. As the compression force builds, the braided sleeve 20 shortens and expands, therein storing energy. The lateral extensions 16 that extend below the head section 12 prevent the head section 12 from passing into the structure of the braided sleeve 20. The ring of foam 26 at the bottom of the braided sleeve 20 prevents the braided sleeve 20 from moving laterally as the braided sleeve 20 is compressed and stores energy.

Figure 4:
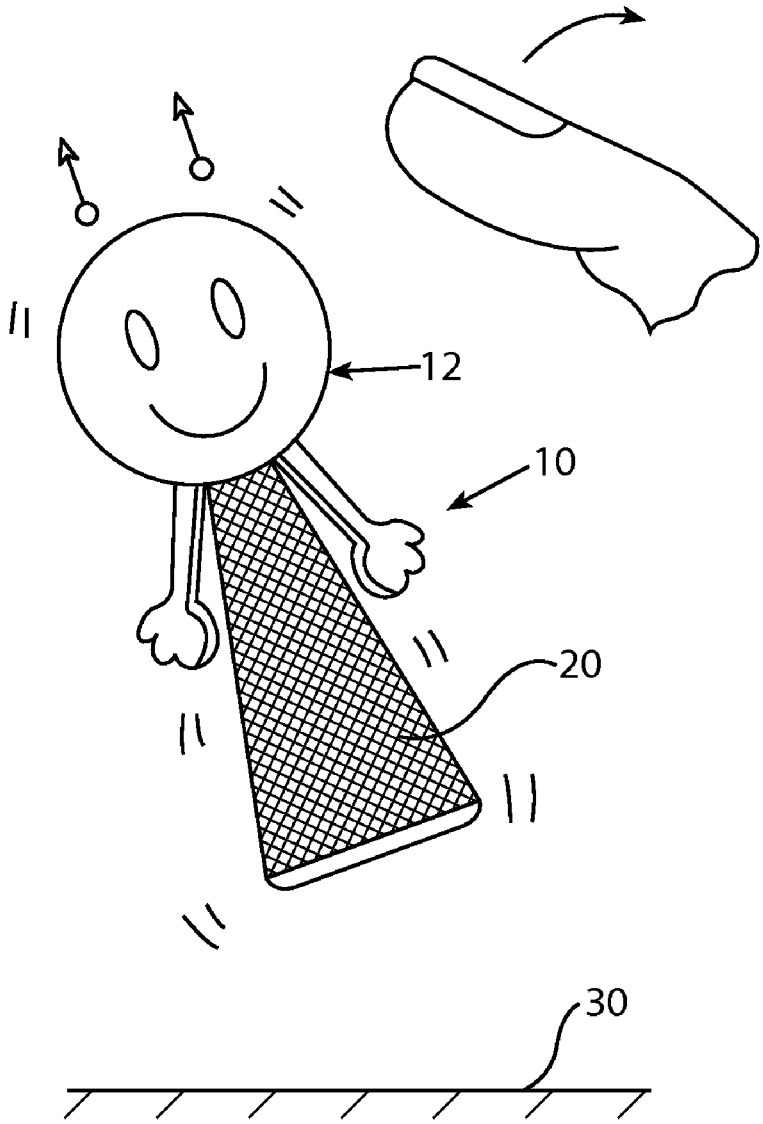
FIG. 4 shows the embodiment of FIG. 3 immediately after a compression force is removed.

Referring to FIG. 4, it can be seen that once the compression force is released, the braided sleeve 20 rapidly returns to its original shape. This drives the head section 12 and the lateral extensions 16 upwardly with enough force to cause the popper toy assembly 10 to pop up and fly away from the flat surface 30.

Figure 5:
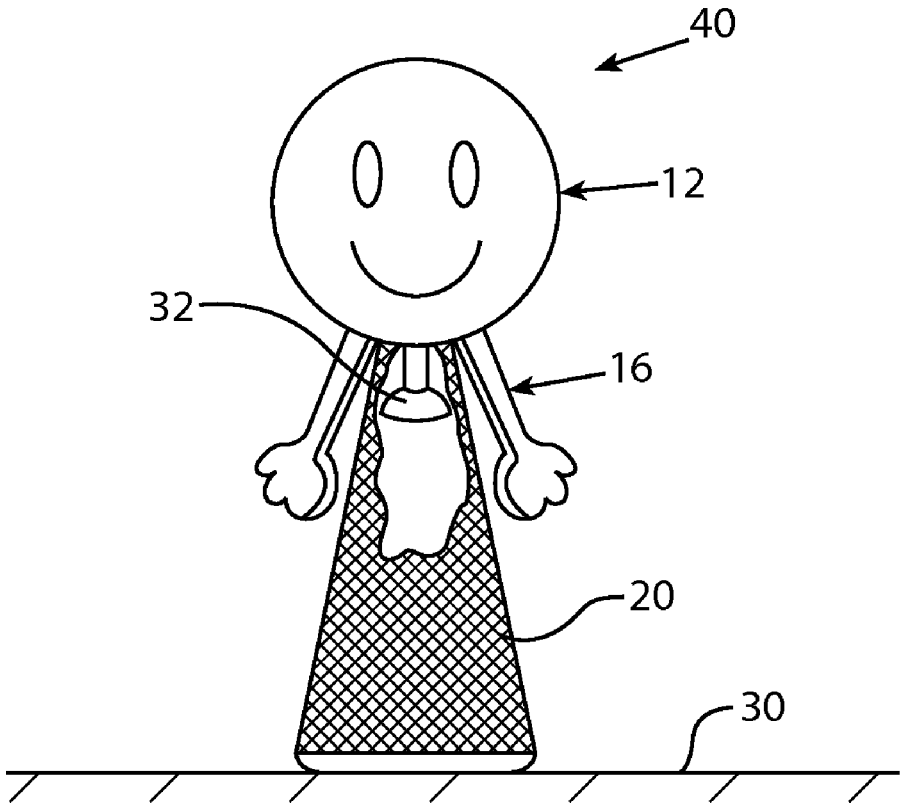
FIG. 5 is a front fragmented view of a second embodiment of a popper toy assembly.

In the embodiment, the compression force is manually applied and released. Referring to FIG. 5 an alternate embodiment of a popper toy assembly 40 is shown that does not require the manual release of the compression force. In the shown embodiment, the head section 12, lateral extensions 16, and braided sleeve 20 are the same as previous embodiments and are identified with the same reference numbers. What is different is the presence of a suction cup 32 under the head section 12 inside the braided sleeve 20. As the braided sleeve 20 is compressed, it shortens. Eventually, the suction cup 32 engages the flat surface 30 under the popper toy assembly 40. The suction cup 32 holds the popper toy assembly 40 in its compressed state. After a short period of time, the suction cup 32 loses suction and releases from the flat surface 30. At this instance, the energy stored by the braided sleeve 20 is released and the popper toy assembly 40 pops into the air.

Figure 6:
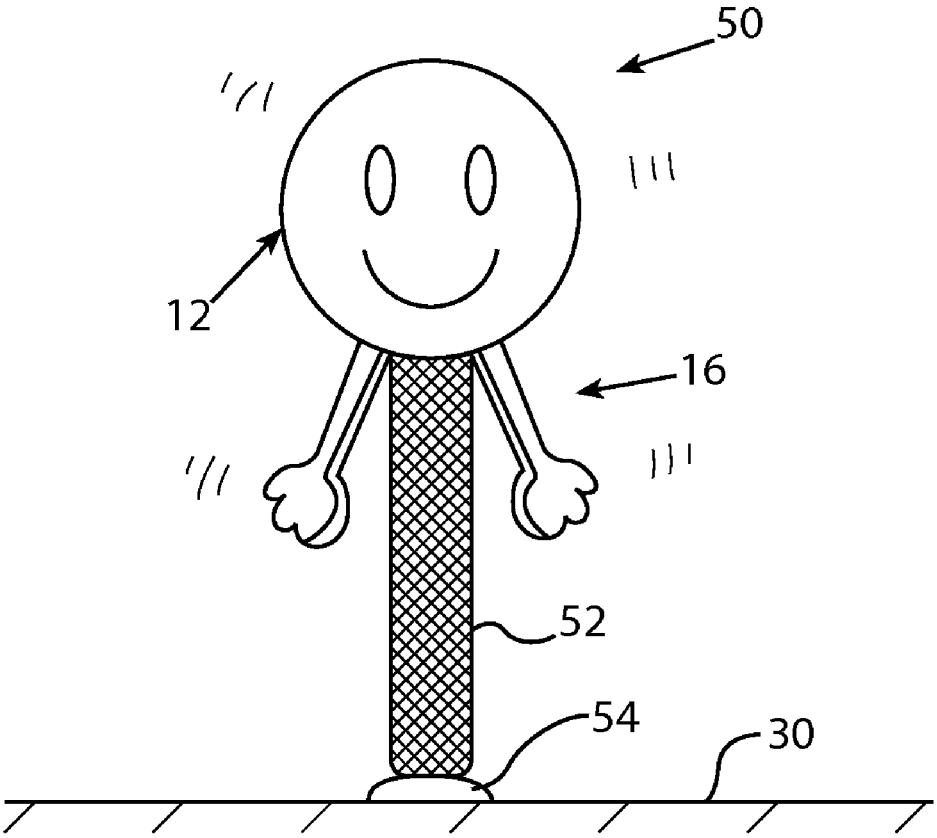
FIG. 6 is a front view of a third embodiment of a popper toy assembly in an uncompressed condition.

Referring to FIG. 6, yet another embodiment of the present invention popper toy assembly 50 is shown. In this embodiment, the braided sleeve 52 of the popper toy assembly 50 has a straight cylindrical shape rather than a frustum shape. The head section 12 and lateral extensions 16 of the popper toy assembly 50 are attached to the top of the braided sleeve 52 in the same manner as previous embodiments and are identified with the same reference numbers. However, in this embodiment, the bottom of the braided sleeve 50 is attached to a suction cup 54.

Figure 7:
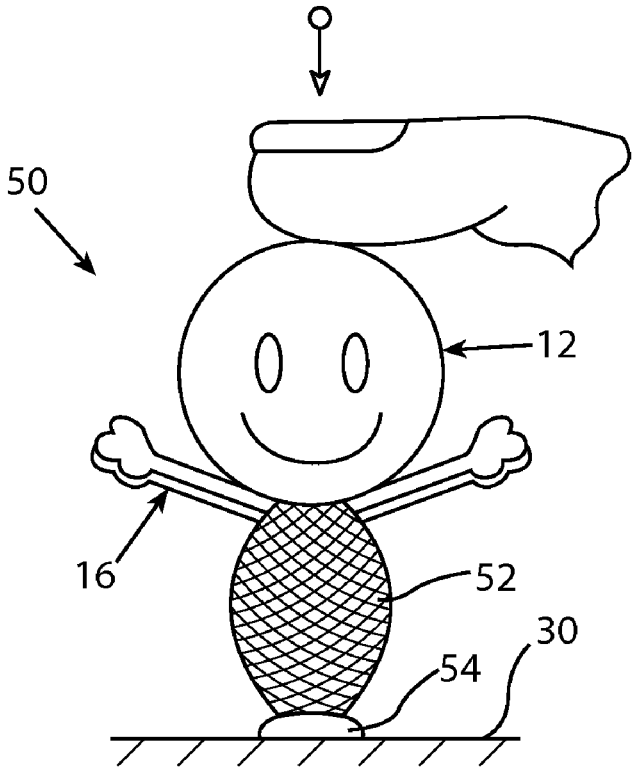
FIG. 7 shown the embodiment of FIG. 4 in a compressed condition.

Referring to FIG. 6 in conjunction with FIG. 7, it can be seen that the suction cup 54 attaches to a flat surface 30. The head section 12 of the popper toy assembly 50 is then pushed downwardly, compressing the braided sleeve 52. Due to the cylindrical shape of the braided sleeve 52, the braided sleeve 52 expands as it is compressed. The compression of the braided sleeve 52 stores energy. Once the compression force is removed, the braided sleeve 52 starts to spring back. The braided sleeve 52 then pops up to its original shape. Due to the engagement of the suction cup 54 on the flat surface 30, the popper toy assembly 50 does not leave the flat surface 50. Rather, the popper toy assembly 50 pops from its short compressed shape into its tall uncompressed shape. Once in its tall uncompressed shape, the head section 12 of the popper toy assembly is free to bobble back and forth.

It will be understood that the embodiments of the present invention that are illustrated and described are merely exemplary and that a person skilled in the art can make many changes to the shown embodiments without departing from the intended scope of the invention. For instance, in the illustrated embodiments, the popper toy assembly is shown as a figure having a simple round head and arm extensions. It should be understood that the popper toy assembly can have many other shapes, such as a rocket ship, mushroom, or flower. Thus, the popper toy assembly can be shaped as a character or any other object as a matter of design choice. All such variations, modifications and alternate embodiments are intended to be included within the scope of the present invention as defined by the claims.

What is claimed is:

1. A method of operating a pop-up toy, comprising the steps of:

providing a toy comprised of a head and a length of a braided sleeve extending from said head, said braided sleeve having a top end anchored to said head and a free bottom end, wherein said braided sleeve is comprised of interwoven strands of plastic, and wherein said braided sleeve stores spring energy sufficient to propel said head and said braided sleeve into flight when in a compressed state;

compressing said braided sleeve by placing said bottom end of said braided sleeve against a surface and applying a compression force to said head to compress said braided sleeve by moving said top end toward said bottom end, therein altering said braided sleeve from an uncompressed state to said compressed state;

removing said compression force when said braided sleeve is in said compressed state, therein causing said braided sleeve to release said spring energy and expand into said uncompressed state with enough force to propel said toy into the air.

2. The method according to claim 1, further including the step of attaching a suction cup to said toy.

3. The method according to claim 2, further including the step of engaging said suction cup against a surface when said braided sleeve is in said compressed state, wherein said suction cup momentarily holds said braided sleeve in said compressed state.

4. The method according to claim 1, wherein said bottom end of said braided sleeve is wider than said top end of said braided sleeve, therein providing said braided sleeve with a frustum shape.

5. The method according to claim 1, further including the step of providing lateral extensions that extend outwardly from said toy between said head and said braided sleeve.

6. The method according to claim 5, wherein said lateral extensions prevent said head from being compressed into said braided sleeve.

7. The method according to claim 2, wherein said suction cup is connected to said bottom end of said braided sleeve.

8. The method according to claim 2, wherein said suction cup is disposed inside said braided sleeve.

9. The method according to claim 1, further including the step of providing a ring of foam that is coupled to said bottom end of said braided sleeve.

* * * * *